United States Patent [19]

Whitney

[11] Patent Number: 4,537,319

[45] Date of Patent: Aug. 27, 1985

[54] CONCENTRIC TAMPER-INDICATING BAND

[75] Inventor: Ralph H. Whitney, Whitehouse, Ohio

[73] Assignee: Owens-Illinois, Inc., Toledo, Ohio

[21] Appl. No.: 673,071

[22] Filed: Nov. 19, 1984

[51] Int. Cl.[3] ..... B65D 41/34

[52] U.S. Cl. ..... 215/252

[58] Field of Search ..... 215/252

[56] References Cited

U.S. PATENT DOCUMENTS 4,352,436 10/1982 Chartier ..... 215/252

4,448,318 5/1984 Lowe ..... 215/252

*Primary Examiner*—Donald F. Norton

*Attorney, Agent, or Firm*—John R. Nelson

[57] ABSTRACT

A tamper-indicating cap and band assembly for use with a container with a neck having external screw threads. The assembly includes a container cap having internal screw threads that mesh with the container neck external screw threads. A coacting tamper-indicating ring band circumferentially encircles the cap and is connected to the cap with a plurality of flexible frangible bridges. The band has a plurality of internal band projections disposed in spaced relation on the inner periphery of the band. The cap has a plurality of spaced cap projections disposed in spaced relation on the outer periphery of the cap and positioned thereon for coacting locking gear tooth type engagement with certain respective band projections on the band when the assembly is threaded onto the container, and for locking gear tooth type engagement with other respective band porjections when the assembly is unscrewed from the container. The cap and band projections are positioned to avoid fracturing the bridges when the cap and band are threaded onto the container in tightening rotation, and when the cap and band assembly is unscrewed from the container the frangible bridges will fracture before the cap will unscrew from the container thus separating the band from the container to indicate prior opening.

5 Claims, 6 Drawing Figures

CONCENTRIC TAMPER-INDICATING BAND

This invention relates to tamper-indicating closures and more particularly to a tamper-indicating cap and pilfer band assembly adapted for threading onto a container neck having external screw threads.

BACKGROUND OF THE INVENTION

A wide variety of closures are known for closing and sealing bottles and other like containers. One type of cap closure is typically provided with internal threads on its side wall portion which are adapted to engage external threads on the neck of the container for retention of the closure on the container. Rotation of the closure with respect to the container results in the closure moving axially of the bottle neck so that the closure may be removed and the container opened.

One desirable feature for closures of the above description is a provision for indicating whether the container has been previously opened by removal of the closure therefrom. To this end, various arrangements for so-called pilfer bands are known. These arrangements are sometimes referred to as tamper bands, guarantee bands, or security rings. Frequently a peripherally extending annular locking ring or other arrangement is provided on the neck of the container for interaction with the pilfer band of the closure for indication of closure tampering.

For a closure made from plastic material, it is desirable that the pilfer band be formed integrally with the shell or cap portion of the closure. When the closure is applied to a container, the integral pilfer band portion of the closure is typically brought into association with the annular locking ring or other arrangement provided on the neck of the container so that the pilfer band operatively interacts therewith for indicating whether the closure has been removed from the container.

Because the application of closures to containers is preferably performed on a high speed production line, it is desirable that application be possible with the fewest number of production steps. Heretofore, the pilfer band arrangement for some plastic closures has required one or more specific production processes for properly associating the pilfer band arrangement with the locking ring or other retaining means provided on the neck of the container.

Many of the tamper-evident closures known heretofore have limited application because of such things, for example, as the cost of making the closure or the need to provide a special container finish suitable for use with the closure.

Among the objectives of the present invention are to provide a package which has a pilfer ring that will function to indicate that the closure has been removed or tampered with, which does not require any special step in the application thereof to the container, which can be readily manufactured and which effectively provides an indication of tampering or removal of the closure.

It is another object of the present invention to provide an improved tamper-indicating seal which is relatively easy to remove from a container without requiring a tool.

Another object of the invention is to provide a tamper-evident closure that is relatively simple, provides readily observable evidence of tampering with the closure and is adaptable for use with a wide range of containers.

A further object of the invention is to provide a tamper-indicating cap and pilfer band assembly of the above type that is simple in construction, inexpensive to manufacture and highly effective in operation.

BRIEF DESCRIPTION OF THE INVENTION

Briefly, the foregoing objects are accomplished by the provision of a tamper-indicating cap and band assembly for use with a container with a neck having external screw threads. The assembly includes a container cap having internal screw threads that mesh with the container neck external screw threads, and a coacting tamper-indicating ring band circumferentially encircling the cap and connected to the cap with a plurality of flexible frangible bridges. The band has a plurality of elongated vertically disposed internal band projections disposed in spaced relation on the inner periphery of the band. The cap has a plurality of elongated vertically disposed spaced cap projections disposed in spaced relation on the outer periphery of the cap and positioned thereon for coacting locking gear tooth type engagement with certain respective band projections on the band when the assembly is threaded onto the container, and for locking gear tooth type engagement with other respective band projections when the assembly is unscrewed from the container. The cap and band projections are positioned to avoid fracturing the bridges when the cap and band are threaded onto the container in tightening rotation, and when the cap and band assembly is unscrewed from the container the frangible bridges will fracture before the cap will unscrew from the container thus separating the band from the container to indicate prior opening. It is preferred that the band circumferentially encircles at least almost the entire circumferential outer surface of the cap thereby ensuring grasping of the band only when the assembly is threaded onto and initially unscrewed from the container.

Other objects and advantages of the invention will be apparent from the following description taken in conjunction with the drawings wherein:

DESCRIPTION OF THE PREFERRED EMBODIMENTS

Figure 1:
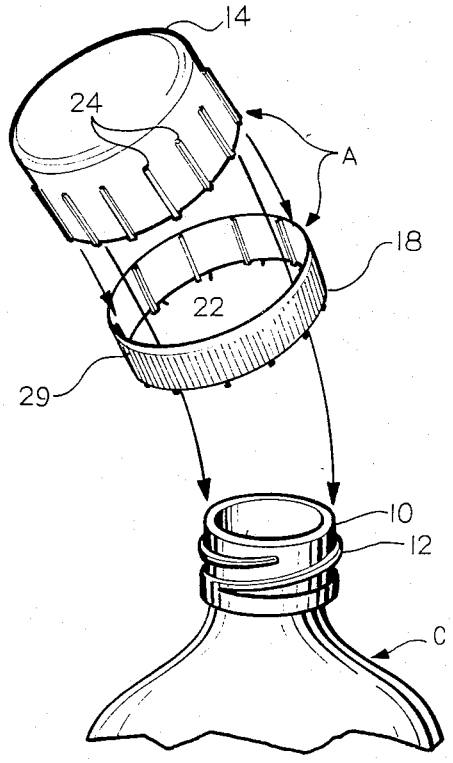
FIG. 1 is a broken perspective view of the tamper-indicating cap and band assembly of the invention shown in relation to its application to the neck of a container.

In the drawings, like numbers and letters are used to identify like and similar parts throughout the several views.

Figure 2:
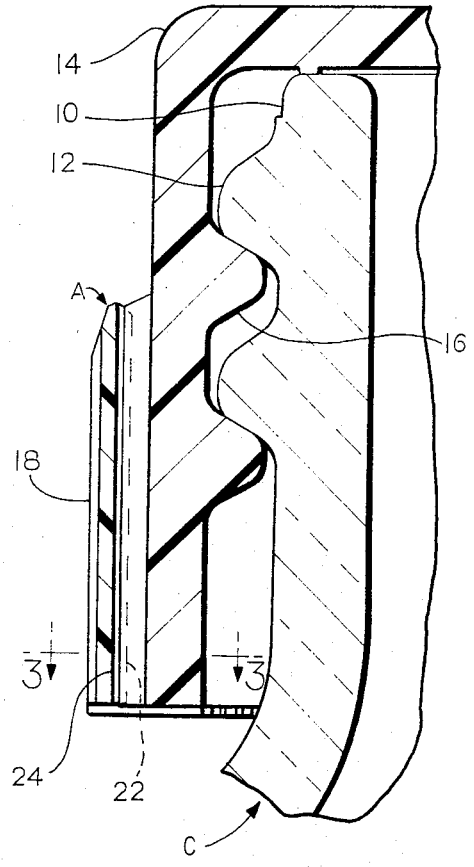
FIG. 2 is an enlarged broken side elevational sectional view showing the cap and band assembly applied to the neck of a container.

Referring first to FIGS. 1 and 2, there is shown a tamper-indicating cap and band assembly of the invention for use with a container C with a neck 10 having external screw threads 12. The assembly includes a container cap 14 having internal screw threads 16 that mesh with the container neck external screw threads 12, and a coacting tamper-indicating ring band 18 circumferentially encircling the cap 14 and connected to the cap with a plurality of flexible frangible bridges 20, such band having a plurality of elongated vertically disposed internal band projections 22 disposed in peripheral spaced relation on the inner periphery of the band. The cap 14 has a plurality of elongated vertically disposed spaced cap projections 24 disposed in peripheral spaced relation on the outer periphery of the cap and positioned thereon for coacting locking gear tooth type engagement with certain respective band projections 22 on the band 18 when the assembly A is threaded onto the container C and for locking gear tooth type engagement with other respective band projections when the assembly is unscrewed from the container. The cap and band projections 24, 22 are peripherally positioned to avoid fracturing the bridges 20 when the cap and band assembly A is threaded onto the container C in tightening rotation, and when the cap and band assembly is unscrewed from the container the frangible bridges will fracture before the cap will unscrew from the container thus separating the band from the container to indicate prior opening, as will be hereinafter explained in more detail.

It is preferred that the band 18 circumferentially encircles at least almost the entire circumferential outer surface of the cap 14 whereby ensuring grasping of the band only when the assembly is threaded onto and unscrewed from the container.

Figure 3:
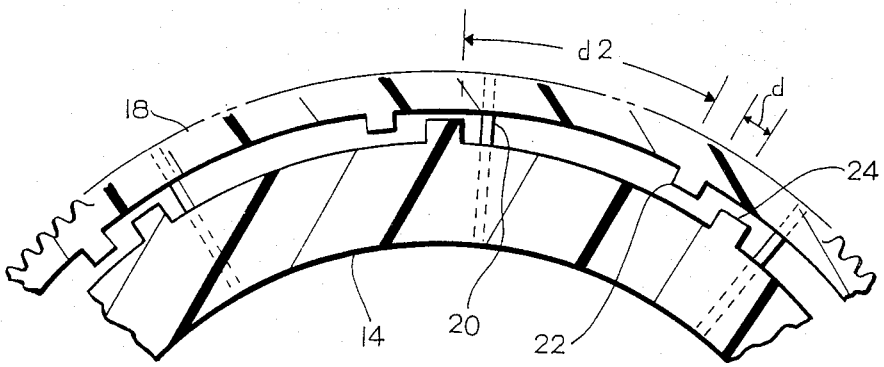
FIG. 3 is a broken top plan view of the cap and band assembly of FIG. 1 and showing the parts in normal position with the frangible bridges unfractured and taken along the line 3—3 of FIG. 2.
Figure 4:
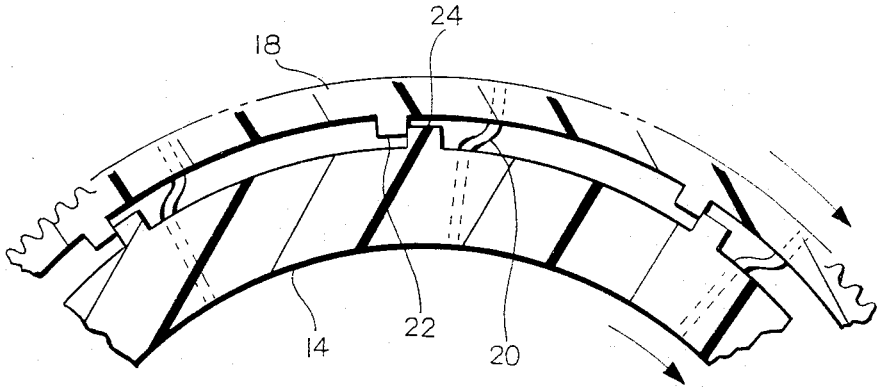
FIG. 4 is a view similar to FIG. 3, but showing the parts in position when the assembly is being threaded onto a container with the cap and band projections interlocking in tightening relation and wherein the frangible bridges are bent but unfractured.

As shown in FIGS. 3 and 4, the spacing between adjacent interacting cap and band projections 24, 22 in the direction of turning the cap 14 to close the container C (as shown by the arrows in FIG. 4) is substantially the same by a first distance d (FIG. 3) that is less than the flexing of the bridges 20 in that direction to fracture same, and the spacing between adjacent of such projections 24, 22 in the uncapping direction of turning being a second distance d2 that is greater than the first distance d and by an amount that exceeds the flexing limit of the bridges 20 for their rupture, thereby indicating prior uncapping of the container.

More specifically, and referring to FIGS. 3–6, the normal or at rest position of the cap 14 and band 18 is shown in FIG. 3 wherein the bridges 20 are unflexed or linear.

In FIG. 4 wherein the cap 14 and band 18 are being threaded onto the container C as indicated by the direction of the arrows, the band projections 22 engage the cap projections 24 enabling the cap to be tightly threaded onto the container, at which time the bridges 20 are distorted but not fractured.

Figure 5:
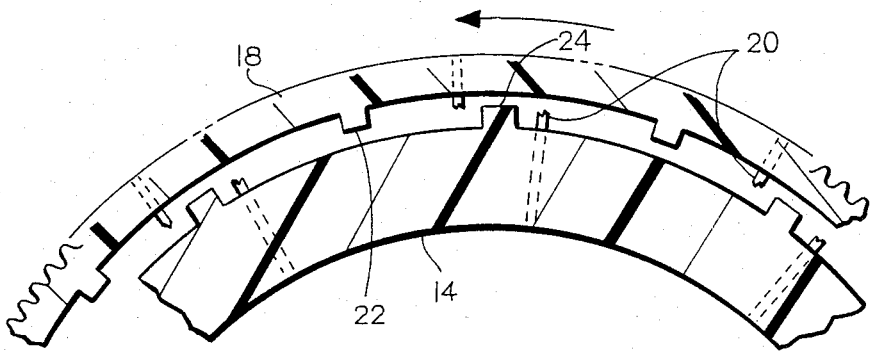
FIG. 5 is a view similar to FIG. 3, but showing the parts being unscrewed from the container immediately after the severing of the bridges.

FIG. 5 shows the start of the unscrewing of the cap and band from the container (in the direction of the arrow) wherein the bridges 20 have been fractured, but the cap and band projections 24, 22 are not yet in engagement to enable unscrewing of the cap from the container.

Figure 6:
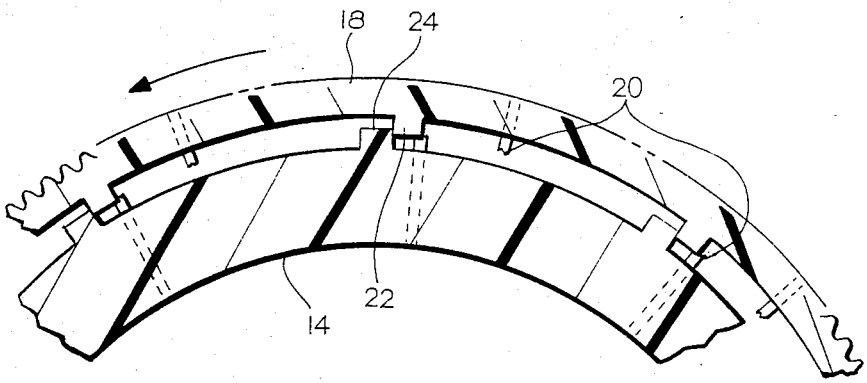
FIG. 6 is a view similar to FIG. 5, but showing the cap and band projections in interlocking unscrewing relation immediately after the position of the parts shown in FIG. 5.

And FIG. 6 shows the engagement of the cap and band projections 24, 22 thus enabling the cap to be unscrewed from the container (in the direction of the arrow) without the band being attached to the cap (since the bridges 20 are broken), thus indicating prior opening.

Serrations 29 are provided on the outer peripheral surface of the band 18 to enable the user to easily grasp the same.

The terms and expressions which have been employed are used as terms of description, and not of limitation, and there is no intention, in the use of such terms and expressions, of excluding any equivalents of the features shown and described or portions thereof, but it is recognized that various modifications are possible within the scope of the invention claimed.

What is claimed is:

1. A tamper-indicating cap and band assembly for use with a container with a neck having external screw threads comprising, a container cap having internal screw threads that mesh with the container neck external screw threads, and a coacting tamper-indicating ring band circumferentially encircling said cap and connected to the cap with a plurality of flexible frangible bridges and having a plurality of internal band projections disposed in peripheral spaced relation on the inner periphery of the band, said cap having a plurality of spaced cap projections disposed in peripheral spaced relation on the outer periphery of the cap and positioned thereon for coacting locking gear tooth type engagement with certain respective band projections on the band when the assembly is threaded onto the container and for locking gear tooth type engagement with other respective band projections when the assembly is unscrewed from the container, said cap and band projections being positioned to avoid fracturing the bridges when the cap and band are threaded onto the container in tightening rotation, and when the cap and band assembly is unscrewed from the container the frangible bridges will fracture before the cap will unscrew from the container thus separating the band from the container to indicate prior opening.

2. The structure of claim 1 wherein the projections on the cap and band are elongated and are vertically disposed.

3. The structure of claim 1 wherein the spacing between adjacent interacting cap and band projections in the direction of turning the cap to close the container is substantially the same by a first distance that is less than the flexing of the bridges in that direction to fracture same and the spacing between adjacent said projections in the uncapping direction of turning being a second distance that is greater than said first distance and by an amount that exceeds the flexing limit of the bridges for their rupture, thereby indicating prior uncapping of the container.

4. The structure of claim 1 wherein said band circumferentially encircles at least almost the entire circumferential outer surface of the cap thereby ensuring grasping of the band only when the assembly is threaded onto and initially unscrewed from the container.

5. The structure of claim 4 wherein said band has a plurality of vertical serrations on its outer peripheral surface to enable the user to easily grasp the same when the assembly is threaded onto and unscrewed off of the container.

* * * * *